US005262290A

United States Patent [19]

Nakatsugawa et al.

[11] Patent Number: 5,262,290

[45] Date of Patent: Nov. 16, 1993

[54] SILVER HALIDE COLOR PHOTOGRAPHIC LIGHT SENSITIVE MATERIAL

[75] Inventors: Hiroshi Nakatsugawa; Takaaki Kojima, both of Odawara, Japan

[73] Assignee: Konica Corporation, Tokyo, Japan

[21] Appl. No.: 870,545

[22] Filed: Apr. 17, 1992

[30] Foreign Application Priority Data

Apr. 22, 1991 [JP] Japan ..... 3-118103

[51] Int. Cl.[5] ..... G03C 1/76

[52] U.S. Cl. ..... 430/537; 430/538; 430/536; 430/509; 430/567

[58] Field of Search ..... 430/537, 538, 536, 509, 430/567

[56] References Cited

U.S. PATENT DOCUMENTS

| | | | |
|---|---|---|---|
| 4,830,956 | 5/1989 | Waki | 430/558 |
| 4,921,781 | 5/1990 | Takamuki et al. | 430/538 |
| 5,011,570 | 4/1991 | Ohbayashi | 430/14 |
| 5,023,169 | 6/1991 | Hirabayashi et al. | 430/505 |

FOREIGN PATENT DOCUMENTS

| | | | |
|---|---|---|---|
| 0391373 | 10/1990 | European Pat. Off. | 430/538 |
| 0028640 | 1/1990 | Japan . | |

*Primary Examiner*—Charles L. Bowers, Jr.
*Assistant Examiner*—Thomas R. Neville
*Attorney, Agent, or Firm*—Frishauf, Holtz, Goodman & Woodward

[57] ABSTRACT

A silver halide light-sensitive material is disclosed, which has high light-sensitive speed and improved gradation and sharpness. The light-sensitive material comprises a paper substrate which has polyolefin resin layers on both sides thereof, and a silver halide emulsion layer provided on one of the polyolefin layers. The polyolefin layer on which the silver halide emulsion layer to be provided contains white pigment particles in an amount of not less than 13 weight percent of the polyolefin resin contained in the polyolefin layer, and surface of the polyolefin layer on which the emulsion layer to be provided has a di-dimensional arithmetical mean deviation of the profile, SRa, of not larger than 0.14 μm, and the silver halide emulsion layer comprises at least two kinds of monodispersed silver halide emulsions each having a silver chloride content of not less than 90 mole % and being different from each other in speed.

18 Claims, No Drawings

SILVER HALIDE COLOR PHOTOGRAPHIC LIGHT SENSITIVE MATERIAL

FIELD OF THE INVENTION

This invention relates to a silver halide color photographic light sensitive material high in sensitive speed, excellent in gradation characteristics and improved on sharpness.

BACKGROUND OF THE INVENTION

In recent years, a light sensitive material high in light-sensitive speed (hereinafter referred as speed) and suitable for a rapid process has been demanded as silver halide photographic light sensitive materials have been popularized, and the improvements of the finished qualities thereof have also been still demanded. In the rapid processes, it has been well-known that silver halide emulsions each containing the silver halide grains substantially comprising AgCl can be developed at a high development speed. When the silver halide emulsions are of the monodispersion type, the effects can more be displayed. However, it has also been known the art that raising in the monodispersibility of silver halide grains causes deterioration in a gradation reproducibility in a shadow portion of images. For the purpose of solving the above-mentioned problem, Japanese Patent Open to Public Inspection (herinafter referred to as 'JP OPI Publication') Nos. 62-5234(1987), 52-172348(1987), 59-148049(1984), 63-71838(1988) and 1-101542(1989), for example, disclose each the silver halide emulsions improved by mixing silver halide emulsions whose sensitive speeds are made different from each other by varying the grain sizes, crystal habits and compositions of the silver halide grains thereof. In these method, however, the sharpness that is essential as one of the image characteristics is deteriorated, though the gradation reproducibility may be improved. As for a method for enhancing the sharpness, on the other hand, it has been known to make use of an anti-irradiation dye. It is, however, not desirable to use it, because a speed is lowered and residual color stain is produced. JP OPI Publication No. 2-28640(1990) disclosed that a sharpness can be somewhat improved when silver halide emulsion is coated on a support comprising a substrate made of a paper sheet coated thereon with a polyolefin resin layer containing 13 wt % of a white pigment. However, the emulsion have had no effect at all on the shadow expression property from the viewpoint of the gradation reproducibility.

SUMMARY OF THE INVENTION

It is an object of the invention to provide a silver halide photographic light sensitive material capable of solving the above-mentioned problems of the conventional techniques, which is high in speed, excellent in both gradation reproducibility and sharpness and, in addition, suitable for a rapid processes.

The above-mentioned objects of the invention can be achieved with a silver halide photographic light-sensitive material comprising a paper substrate which has polyolefin resin layers on both sides thereof, and a silver halide emulsion layer provided on one of the polyolefin layers, wherein the polyolefin layer on which the silver halide emulsion layer to be provided contains white pigment particles in an amount of not less than 13 weight percent of a polyolefin resin contained in the polyolefin layer, and the surface of the polyolefin layer on which the silver halide emulsion layer to be provided has a di-dimensional arithmetical mean deviation of the profile, SRa, of not larger than 0.14 μm, the SRa is calculated by the following Equation I, and the silver halide emulsion layer comprises at least two kinds of monodispersed silver halide emulsions each having a silver chloride content of not less than 90 mole % and being different from each other in speed thereof:

$$SRa = \frac{1}{S_M} \int_0^{Lx} \int_0^{Ly} |f(x,y)| \, dxdy \qquad \text{Equation I}$$

wherein Lx is the length of measuring area of specimen in X-axis direction and Ly is the length of measuring area of specimen in Y-axis direction and $S_M$ is the measuring area of specimen.

DETAILED DESCRIPTION OF THE INVENTION

The substrates of the invention which are comprised of paper sheets may be selected from the raw materials generally applicable to photographic print paper. For example, they include a natural pulp, a synthetic pulp, a natural and synthetic pulp mixture and, besides, a variety of the raw materials for combination paper sheets. Generally, a natural pulp mainly comprising a broad-leaved tree, a coniferous tree or the mixtures thereof may be used for.

The surfaces of the above-mentioned pulp may also be subjected to sizing treatment with a layer-forming polymer such as gelatin, starch, carboxylmethyl cellulose, polyacrylamide, polyvinyl alcohol and a modified polyvinyl alcohol. The above-mentioned modified polyvinyl alcohol applicable thereto include a polyvinyl alcohol modified with carboxyl group or silanol, and a copolymer with an acrylamide. When a surface sizing-treatment is carried out with the above-mentioned layer-forming polymers, the layer-forming polymer is so controlled as to be coated in an amount within the range of 0.1 to 5.0 g/m$^2$ and, preferably, 0.5 to 2.0 g/m$^2$. In this case, it is also allowed to add, if required, an antistatic agent, a fluorescent whitening agent, a pigment and a defoaming agent to the layer forming polymers.

The foregoing substrates are produced in the manner that a sheet of paper is made of the above-mentioned pulp and, if required, a pulp slurry containing additives such as a salt, a sizing agent, a paper-strength reinforcing agent and a fixing agent, by making use of a paper-making machine such as a fourdrinier paper-making machine and the resulting paper is dried and is then taken up. The above-mentioned surface size treatment is carried out either before or after the drying and a calendering is carried out between the time after completing the drying and the time of taking up the resulting substrate. When the surface size treatment is carried out after the drying, the calendering may be carried out either before or after carrying out the surface size treatment.

Polyolefin resin layers are provided on both side of thus obtained substrate.

The white pigments applicable to the invention include inorganic and/or organic white pigments and, among them, inorganic white pigments are preferred. The inorganic white pigments include, for example, alkali earth metal sulfates such as barium sulfate; alkali earth metal carbonates such as calcium carbonate; finely powdered silicic acid, silica of a synthetic silicate, calcium silicate, alumina, an alumina hydrate, titanium oxide, zinc oxide, talc and clay. Among them, barium sulfate, calcium carbonate and titanium oxide are desirable and, barium sulfate and titanium oxide are preferable. Such a titanium oxides may be of the rutile type and the anatase type either. For this purpose, it is also allowed to use those coated on the surfaces thereof with a metal oxide such as hydrated alumina oxide or a hydrated ferrite.

The white pigments of the invention are added into the polyolefin-resin layer on the side of substrate on which an emulsion layer to be coated. The white pigments may be contained therein in a content of not less than 13% by weight and, preferably, within the range of 13 to 50% by weight of the resin contained in this layer. It would be better to disperse the white pigments densely and uniformly in the polyolefin-resin layer.

The polyolefin-resins applicable to the invention may be selected from α-olefin copolymers such as polyethylene and polypropylene and the mixtures of the independent polymers thereof. Among them, those preferably applicable thereto include, particularly, a low-density polyethylene, a high-density polyethylene and the mixtures thereof. There is no special limitation to the molecular weights of the polyolefin-resins. However, the molecular weight thereof may generally be within the range of 20000 to 200000. The thickness of the resin layer is to be within the range of 5 to 200 μm and, preferably, 30 to 100 μm. Usually, the resin is mixedly kneaded with a white pigment by a melt mixing process and is laminated on a raw paper through a melt-extruder It is allowed to use an unsaturated organic compound having one or more polymerizable double bond of carbon-carbon including a methacrylate type compound such as those described in Japanese Patent Publication Open to Public Inspection (hereinafter referred to as JP OPI Publication) Nos. 57-27257(1982), 57-49946(1982) and 62-262738(1986), and the tetraacrylates represented by the formula given in JP OPI Publication No. 61-262738(1986). In the above-mentioned case, it is coated on a substrate and is then cured by irradiating electron beam thereto, so that a polyolefin resin layer may be prepared. The white pigments and so forth are dispersed in the above-mentioned unsaturated organic compounds. It is also allowed to disperse them upon mixing them with other resins.

The methods of coating a polyolefin-resin layer of the invention include, for example; the lamination method described in The Research Society of Processing Technology, "A Handbook of New Lamination Processes"; a dry-lamination method; and a non-solvent type dry-lamination method. The methods of coating them may be selected from those of the gravure roll type, the wire-bar type, the doctor-blade type, the reverse-roll type, the dipping type, the air-knife type, the calender type and the kiss type.

The di-dimensional arithmetical mean deviation of the profile of the surface of a substrate covered by a polyolefin-resin layer is measured three-dimensionally by a styrus-tracing type surface-roughness form measurement equipment. A subject test surface region having area $S_M$ is picked out of the curved rough surface obtained thereby and the subject test surface region is placed on the center of the curved rough surface. When rectangular coordinate axes X and Y are set on the surface center of the picked out subject test surface region and an axis intersecting perpendicularly to the center of the surface is named Z and, further, the curved rough surface is represented by Z=f(x,y), it was proved that the di-dimensional arithmetical mean deviation of the profile of the surface (SRa) is less than 14 μm the more it becomes preferable.

$$SRa = \frac{1}{S_M}\int_0^{Lx}\int_0^{Ly} |f(x,y)|\, dxdy \qquad \text{Equation I}$$

wherein Lx represents a length in the X axis direction of a subject test surface region; Ly represents a length in the Y axis direction of the subject test surface region; and $S_M$ represents an area of the subject test surface region.

The above-mentioned measurement method was carried out in accordance with JIS-B0601 specified for the measurements of a two-dimensional place, provided the JIS-B0601 was applied to three-dimensional spaces. For two-dimensional space, JIS B 0601 describes the center-line means roughness, when the roughness curve has been expressed by y=f(x), as a value, being expressed in micrometer (μm), that is obtained from the following formula, extracting a part of measuring length 1 in the direction of its center-line from the roughness curve, and taking the center-line of this extracted part as X-axis and the direction of vertical magnification a Y-axis.

$$R_a = \frac{1}{l}\int_0^{l} |f(x)|\, dx$$

The measurement equipment applicable to the analyses include, for example, the stylus-tracing type surface roughness analyzer Model SE-30H manufactured by Kosaka Laboratories.

The most essential point for the measurement method is to specify the area of a subject test surface region. It is, therefore, preferred to take an area enclosed with 5 mm of the length in the X axis direction and 1 mm of the length in the Y axis direction so that a cut-off value to be 0.8 mm. When taking the area of such a subject test surface region as mentioned above, the area thereof can be corresponded to a di-dimensional arithmetical mean deviation of the profile of surface (SRa) a sharpness. When an SRa is larger than 14 μm, the sharpness cannot be allowable. Therefore, an SRa value is the smaller, the better. Particularly, an SRa value is most desirable when it is within the range of 0.05 to 0.14 μm.

The processes of producing a polyolefin resin coated photographic support of the invention having a di-dimensional arithmetical mean deviation of the profile of surface (SRa) of not larger than 0.14 μm can be performed by adopting the following production processes, independently or in combination, in both of producing a base paper for paper substrates and processing a polyolefin coated layer. However, there shall not be any limitation thereto.

In producing a base paper for paper substrates, (1) In the composition of a pulp applicable thereto, not more than 40% of the pulp of needle-leaved tree and not less than 60% of the pulp of broad-leaved tree are to be compounded. The resulting pulp is to be smashed to pieces until showing a Canadian standard freeness within the range of 200 to 300 ml in the total amount;

(2) The flow rate of a paper material in an inlet is so controlled as to be within the range of 0.10 to 0.35 m/sec; and (3) The linear pressure of a wet-press is so controlled as to be within the range of 20 to 80 kg/cm, and the linear pressure of a presure rolls interposed in a dryer is so controlled as to be within the range of 30 to 100 kg/cm in the conditions of not lower than 35% of the moisture content of a wet paper sheet.

In the process of coating a polyolefin-resin layer, a cooling rolls and a pressure roll are applied with a nip pressure of a high linear pressure within the range of 20 to 45 kg/cm and the polyolefin-resin coated layer is so controlled as to have a thickness within the range of 10 to 40 μm.

Each of the silver halide emulsion applicable to at least one layer of light-sensitive material of the invention comprised silver chlorobromide grains having a silver chloride content of not less than 90 mol %, desirably, not less than 95 mol % and, preferably, not less than 99 mol %.

There is no special limitation to the methods of preparing the monodisperse type silver halide emulsions applicable to the invention, which are each different in sensitive speeds. For example, it is allowed to mix two or more kinds of monodisperse type silver halide emulsions each different in the average grains sizes together. In the mixation of the two or more kinds of monodisperse type silver halide emulsions, the sensitive speed difference between a relatively highest speed emulsion and a relatively lowest speed emulsion is to be within the range of, desirably, 0.05 to 0.6 and, preferably, 0.1 to 0.5 in the logarithm of difference of the exposure amounts necessary for forming images having a density of 0.8 for each of the emulsions, respectively. The speed of each emulsion is measured with a sample having a single layer of the emulsion on a support. There is no special limitation to the mixing ratios thereof.

The grain sizes distribution of the silver halide emulsion relating to the invention is preferably has a variation coefficient of not more than 0.22 and, particularly, not more than 0.15. Herein the term, 'a variation coefficient', means a coefficient indicating the broadness of a grain size distribution and is represented by (the standard deviation of a grain size distribution / an average grain size).

Any desired configurations of the silver halide grains relating to the invention can be used. One of the preferable examples of the configurations is a cube having (100) planes as the crystal faces of the cube.

In the processes described in U.S. Pat. Nos. 4,183,756 and 4,225,666 and JP OPI Publication No. 55-26589(1980), JP Examined Publication No. 55-42737(1980) and The Journal of Photographic Science (J. Pho. Sci.), 21, 39, (1973), grains having a cubic, tetradeca hedral or dodeca hedral configuration can be prepared and then used. It is also allowed to use the grains having twinned crystal faces or irregular configurations.

In the invention, the silver halide grains relating to the invention, which have a silver chloride content of not less than 90 mol %, such as silver chlorobromide grains, preferably can be chemically sensitized by making use of a sulfur sensitizer and a gold sensitizer.

Any known sulfur sensitizers may be applied thereto. For example, the sulfur sensitizers applicable thereto include a thiosulfate, an allylthiocarbamido thiourea, an allylisothiocyanate, cystine, a p-toluenethiosulfonate and rhodanine. Besides the above, the sulfur sensitizers described in U.S. Pat. Nos. 1,574,944, 2,410,689, 2,278,947, 2,728,668, 3,501,313 and 3,656,955; German Patent No. 1,422,869; and JP OPI Publication Nos. 56-24937(1981) and 55-45016(1980) can be used. The sulfur sensitizer mentioned above may be added in such an amount as is capable of sensitizing silver halides and there is no special limitation thereto. However, as the rough standard in the case of sodium thiosulfate for example, it may be contained in an amount within the range of, desirably, $1\times10^{-7}$ to $1\times10^{-5}$ mols and, preferably, $2\times10^{-6}$ to $8\times10^{-6}$ mols per mol of silver halide used.

As for the gold sensitizers applicable thereto, a variety of gold compounds having a gold with an oxidation number of either +1 valency or +3 valency. The typical examples thereof include a chloroaurate, a potassium chloroaurate, an auric trichloride, a potassium auric thiocyanate, a potassium iodoaurate, a tetracyanoauric acid, an ammonium aurothiocyanate and a pyridyl trichloro gold.

The amounts of such a gold sensitizers to be added may be varied in various conditions. They may be added in a concentration within the range of, desirably, $5\times10^{-7}$ to $5\times10^{-3}$ mols, more desirably, $2\times10^{-6}$ to $1\times10^{-4}$ mols, particularly, $2.6\times10^{-6}$ to $4\times10^{-5}$ mols and, preferably, $2.6\times10^{-6}$ to $9\times10^{-6}$ mols, per mol of silver halide used.

The gold compounds may be added an any desired stages of the processing steps of preparing a silver halide emulsion. It is, however, preferable to add them in the courses between the completion of forming the silver halide and the completion of a chemical sensitization.

The silver halide emulsions applicable to the silver halide light sensitive materials of the invention may be added with the compounds so-called an antifoggant and a stabilizer, for the purposes of applying an optimum chemical sensitization to the emulsions or preventing the emulsions from lowering the sensitive speeds or from producing fogs in the courses of preserving or developing the light sensitive materials.

The above-mentioned compounds have been known as a variety of heterocyclic compounds and mercapto compounds as well as 4-hydroxy-6-methyl-1,3,3a,7-tetrazaindene, 3-methylbenzothiazole and 1-phenyl-5-mercaptotetrazole. Among them in particular, the compounds preferably applicable thereto include a purine derivative and the mercapto compounds represented by the following Formula [S];

Formula [S]

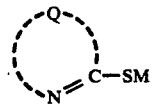

wherein Q represents a 5- or 6-member heterocyclic ring or a group of atoms necessary to form a 5- or 6-member heterocyclic ring; and M represents a hydrogen atom or a cation.

The heterocyclic rings formed by Q include, for example, those of imidazole, triazole, thiadiazole, oxadiazole, tetrazole, thiazole, oxazole, selenazole, triazine, benzoimidazole, naphthoimidazole, benzothiazole, naphthothiazole, benzoselenazole, naphthoselenazole and benzoxazole.

The cations represented by M include, for example, an alkali metal such as sodium and potassium, and an ammonium group.

The typical examples of the heterocyclic compounds capable of forming the silver ions and the hardly soluble salts each applicable to the invention will be given below.

S-1

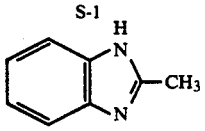

S-2

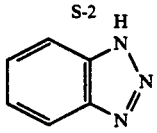

S-3

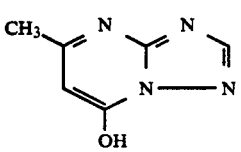

S-4

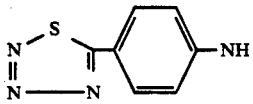

S-5

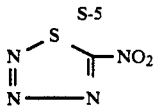

S-6

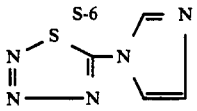

S-7

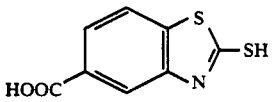

S-8

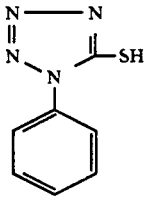

S-9

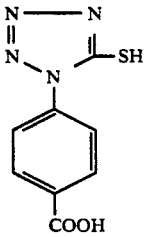

S-10

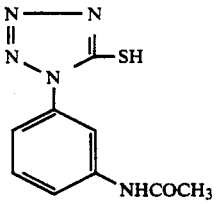

S-11

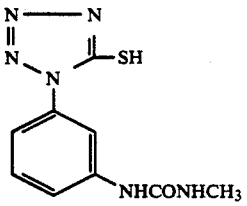

S-12

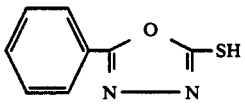

S-13

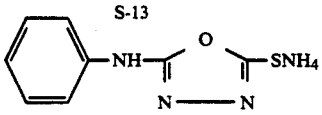

S-14

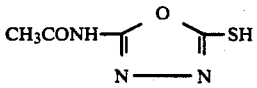

-continued

S-15

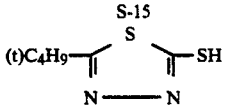

S-16

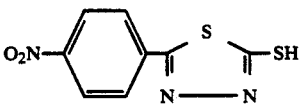

S-17

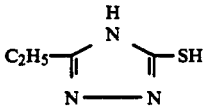

S-18

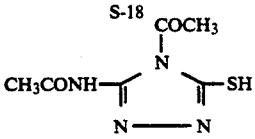

S-19

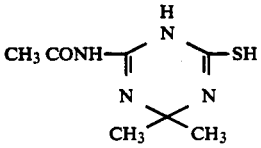

S-20

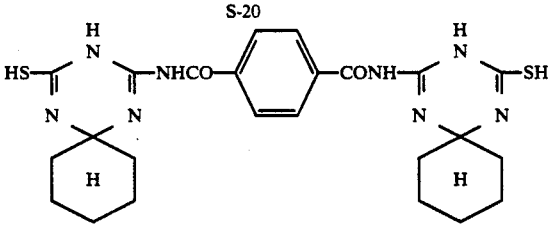

The above-given compounds are described in JP OPI Publication Nos. 63-36243(1988), 63-146044(1988) and 1-196035(1989).

The silver halide emulsions relating to the invention can be spectrally sensitized to a desired wavelength region by making use of the dyes having been known as the sensitizing dyes in the photographic industry. Such sensitizing dyes may be used independently or in combination. It is also allowed to add into an emulsion, together with the sensitizing dyes, the so-called supersensitizers capable of enhancing the sensitizing function of the sensitizing dyes, which are either the dyes each not having any spectral sensitizing function in itself or the compounds each substantially incapable of absorbing any visible rays of light.

A variety of sensitizing dyes can be used for the above-mentioned purposes and each of them can be used independently or in combination. The sensitizing dyes advantageously applicable to the invention include, for example, those given below.

The sensitizing dyes applicable to blue light-sensitive silver halide emulsions include, for example, those given in West German Patent No. 929,080; U.S. Pat. Nos. 2,231,658, 2,493,748, 2,503,776, 2,519,001, 2,912,329, 3,656,959, 3,672,897, 3,694,217, 4,025,349 and 4,046,572; British Patent No. 1,242,588; and JP Examined Publication Nos. 44-14030(1969) and 52-24844(1977). The sensitizing dyes applicable to green light-sensitive silver halide emulsions include, typically, cyanine dyes, melocyanine dyes or compound cyanine dyes such as those given in U.S. Pat. Nos. 1,939,201, 2,072,908, 2,739,149 and 2,945,763; British Patent No. 505,979. The sensitizing dyes applicable to red light-sensitive silver halide emulsions include, typically, cyanine dyes, melocyanine dyes or compound cyanine dyes such as those given in U.S. Pat. Nos.2,269,234, 2,270,378, 2,442,710, 2,454,629 and 2,776,280. Further, the cyanine dyes, melocyanine dyes or the compound cyanine dyes such as those described in U.S. Pat. Nos. 2,213,995, 2,493,748 and 2,519,001; and West German Patent No.929,080 can also be used advantageously to green or red light sensitive silver halide emulsions.

The above-mentioned sensitizing dyes may be used independently or in combination. In particular, they are often used in combination with the purpose of supersensitizing an emulsion. The typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377 and 4,026,707; British Patent Nos. 1,344,281 and 1,507,803; JP Examined Publication Nos. 43-4936(1968) and 53-12375(1978); and JP OPI Publication Nos. 52-110618(1977) and 52-109925(1977).

There is no special limitation to the amounts of the above-mentioned sensitizing dyes to be added. However, they are usually added in an amount within the range of, desirably, $1\times10^{-7}$ to $1\times10^{-3}$ mols per mol of silver halide used and, preferably, $5\times10^{-6}$ to $5\times10^{-4}$ mols.

These sensitizing dyes may be added in any methods well known in the art.

Such sensitizing dyes may be added in the silver halide emulsions of the invention by dissolving the dyes in one and the same solvent or different solvents and then the solvents are either mixed up with the emulsions before the dyes are added in the silver halide emulsions or added separately to the emulsions. When adding them separately, the order, time and intervals of adding them may be so desirably determined as to meet the purposes. The sensitizing dyes may be added into an emulsion at any point of time in the course of carrying out the emulsion preparation steps. However, they are added at the point of time, desirably, when carrying out or completing the chemical ripening step and, among the addition points of time, it is preferable to add them at the point of time when carrying out the chemical ripening step.

In the case of applying the silver halide photographic light sensitive materials of the invention to a color photographic light sensitive material, it is usual that a yellow dye forming coupler is used in a blue sensitive emulsion layer; a magenta dye forming coupler, in a green sensitive emulsion layer; and a cyan dye forming coupler in a red sensitive emulsion layer; respectively. It is, however, allowed to prepare a silver halide color photographic light sensitive material by making use of any other combinations different from the above-mentioned combination so as to meet the application of the light sensitive material.

It is desirable that the above-mentioned dye forming couplers contain, in the molecules thereof, the so-called ballast group having not less than 8 carbon atoms, that makes them non-diffusible. These dye forming couplers may be either of the 4-equivalent type in which 4 molecular silver ions are required to be reduced for forming one molecular dye, or of the 2-equivalent type in which 2 molecular silver ions only may be reduced.

It is preferable that the emulsion layer of the invention a emulsion layer containing a yellow dye forming coupler. As for the yellow dye forming couplers, a variety of acyl acetoanilide type couplers may desirably be used. Among them, the couplers represented by the following Formula Y-1 can be used advantageously.

Formula Y-1

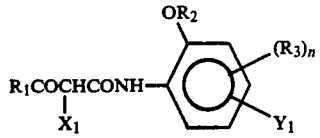

wherein $R_1$ represents an alkyl group, a cycloalkyl group or an aryl group; $R_2$ represents an alkyl group, a cycloalkyl group, an acyl group or an aryl group; $R_3$ represents a group substitutable to a benzene ring; n is an integer of 0 or 1; $X_1$ represents a hydrogen atom or a substituent capable of splitting off when it couples to the oxidized product of a developing agent; and $Y_1$ represents an organic group.

In the above-given Formula Y-1, the alkyl groups represented by $R_1$ include, for example, a methyl group, an ethyl group, an isopropyl group, a t-butyl group and a dodecyl group. The alkyl groups represented by $R_1$ include those having substituents such as a halogen atom, an aryl group, an alkoxy group, an aryloxy group, an alkylsulfonyl group, an acylamino group and a hydroxy group.

The cycloalkyl groups represented by $R_1$ include, for example, a cyclopropyl group, a cyclohexyl group and, besides, an organic hydrocarbon residual group condensed with two or more cycloalkyl such as an adamantyl group. The cycloalkyl groups represented by $R_1$ include those having substituents such as those exemplified as the substituents to the alkyl groups represented by $R_1$. The aryl groups represented by $R_1$ include, for example, a phenyl group. The aryl groups include those having substituents such as those exemplified as the substituents to the alkyl groups represented by $R_1$ and an alkyl group. Among those represented by $R_1$, a branched alkyl groups are preferred.

In the above-given Formula Y-1, the alkyl, cycloalkyl and aryl groups each represented by $R_2$ include, for example, the same groups as given in $R_1$ which include those having substituents such as those exemplified in $R_1$. The acyl groups include, for example, an acetyl group, a propionyl group, a butyryl group, a hexanoyl group and a benzoyl group. The acyl groups also include those having substituents. The groups represented by $R_2$ include, desirably, an alkyl or aryl group, more desirably an alkyl group and, preferably, a lower alkyl group having not more than 5 carbon atoms.

In Formula Y-1, the groups represented by $R_3$ substitutable to benzene rings include, for example, a halogen atom such as a chlorine atom, an alkyl group such as an ethyl group, an isopropyl group and a t-butyl group, an alkoxy group such as a methoxy group, an aryloxy group such as a phenyloxy group, an acyloxy group such as an acetyloxy group and a benzoyloxy group, an acyloxy group such as an acetamido group and a benzoylamino group, a carbamoyl group such as an N-methylcarbamoyl group and an N-phenylcarbamoyl group, an alkylsulfonamido group such as an ethylsulfonamido group, an arylsulfonamido group such as a phenylsufonamido group, a sulfamoyl group such as an N-propylsulfamoyl group and an N-phenylsulfamoyl group and an imido group such as a succinimido group and a glutarimido group.

In Formula Y-1, $Y_1$ represents an organic group and, preferably, the groups represented by the following Formula Y-II;

$$-(J)_p-R_4 \qquad \text{Formula Y-II}$$

In the above-given Formula Y-II, $R_4$ represents an organic group containing one coupling group having a carbonyl or sulfonyl unit; and p is an integer of 0 or 1.

The groups each having a carbonyl unit include, for example, an esterized carboxy group, an amido group, a carbamoyl group, a ureido group and a group having a urethane bond. The groups each having a sulfonyl unit include, for example, a sulfonyl group, a sulfonylamino group, a sulfamoyl group and an aminosulfonylamino group.

J represents $$-\underset{\underset{R_5}{|}}{N}CO- \text{ or } -\underset{\underset{R_5}{|}}{N}CO-$$

in which $R_5$ represents a hydrogen atom, an alkyl group, an aryl group or a heterocyclic group.

The alkyl groups represented by $R_5$ include, for example, a methyl group, an ethyl group, an isopropyl group, a t-butyl group and a dodecyl group. The aryl groups represented by $R_5$ include, for example, a phenyl group or a naphthyl group. The heterocyclic groups represented by $R_5$ include, for example, a pyridyl group.

Each of the groups represented by $R_5$ include those having each a substituent. There is no special limitation to such substituents, however, they include, typically, a halogen atom such as a chlorine atom, an alkyl group such as an ethyl group and a t-butyl group, an aryl group such as a phenyl group, a p-methoxyphenyl group and a naphthyl group, an alkoxy group such as an ethoxy group and a benzyloxy group, an aryloxy group such as a phenoxy group, an alkylthio group such as an ethylthio group, an arylthio group such as a phenylthio group, an alkylsulfonyl group such as a β-hydroxyethylsulfonyl group, an arylsulfonyl group such as a phenylsulfonyl group, an acylamino group such as an alkylcarbonylamino group, e.g., an acetamido group and an arylcarbonylamino group, e.g., a benzoylamino group, a carbamoyl group such as an alkylcarbamoyl group, e.g., an N-methylcarbamoyl group and an arylcarbamoyl group, e.g., an N-phenylcarbamoyl group, an acyl group such as an alkylcarbonyl group, e.g., an acetyl group and an arylcarbonyl group, e.g., a benzoyl group, a sulfonylamino group such as an alkylsulfonylamino group, e.g., a methylsulfonamino group and an arylsulfonylamino group, e.g., a phenylsulfonylamino group, a sulfamoyl group such as an alkylsulfamoyl group, e.g., an N methylsulfamoyl group and an arylsulfamoyl group, e.g., an N-phenylsulfamoyl group, a hydroxy group and a nitrile group.

In the foregoing Formula Y-I, the groups each capable of splitting off when making a coupling reaction with the oxidized product of a developing agent, which are represented by $X_1$, include, for example, the groups represented by either one of the following Formulas Y-III and Y IV and, among the groups, the groups represented by Formula Y-IV are preferred.

$$-OR_6 \qquad \text{Formula Y-III}$$

In the Formula Y-III, $R_6$ represents an aryl group or a heterocyclic group, each containing a substituent.

Formula Y-IV

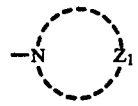

In the above-given Formula Y-IV, $Z_1$ represents the group of non-metal atoms, which is necessary to form a 5- or 6-member ring. The atomic groups necessary to form the group consisting of non-metal atoms include, for example, a substituted or non-substituted methylene and methine, $$>C=O,\ -\overset{|}{N}R_A$$

in which $R_A$ is synonymous with the foregoing $R_5$, —N=, —O—, —S— and —$SO_2$—.

The yellow couplers represented by the foregoing Formula Y-I are also allowed to form a bis member upon coupling to $R_1$, $R_3$ or $Y_1$.

The preferable yellow couplers of the invention include, particularly, the compounds represented by the following Formula Y-V;

Formula Y-V

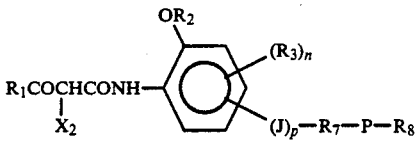

In the above-given Formula Y-V, $R_1$, $R_2$, $R_3$, n and J are synonymous with $R_1$, $R_2$, $R_3$, n in Formula Y-I and J, p in Formula Y-II and the same ones can be exemplified as those represented by Formulas Y-I and Y-II, respectively; $R_7$ represents an alkylene group, an arylene group, an alkylenearylene group, an arylenealkylene group or —A—$V_1$—B (in which A and B represent each an alkylene group, an arylene group, an alkylenearylene group or an arylenealkyl group, and $V_1$ represents a divalent coupling group); $R_8$ represents a coupling group having a carbonyl or sulfonyl unit; and $X_2$ represents a group capable of splitting off upon coupling with the oxidized product of a developing agent.

In Formula Y-V, the alkylene groups represented by $R_7$, A or B include, for example, those having each a straight-chain or branched chain, such as a methylene group, an ethylene group, a trimethylene group, a butylene group, a hexylene group, a methylmethylene group, an ethylethylene group, a 1-methylethylene group, a 1 methyl 2-ethylethylene group, a 2-decylethylene group and a 3-hexylpropylene group. The alkylene groups such as a 1 benzylethylene group, a 2-phenylethylene group and a 3-naphthylpropylene group include those having each a substituent.

The arylene groups include, for example, a phenylene group and a naphthylene group, which also include those each having a substituent.

The alkylenearylene groups include, for example, a methylenephenyl group. The arylenealkylene groups include, for example, a phenylenemethylene group and those each having a substituent. The divalent coupling members represented by $V_1$ include, for example, —O— or —S— atoms.

Among the alkylene groups, arylene groups, alkylenearylene groups, arylenealkylene groups and —A—$V_1$—B, the alkylene groups are preferred.

In the foregoing Formula Y-V, the groups represented by $R_8$ include, for example, the straight-chained or branched groups such as an ethyl group, a butyl group, a hexyl group, an octyl group, a 2-ethylhexyl group, a dodecyl group, a hexadecyl group, a 2-hexyldecyl group and an octadecyl group. The cycloalkyl groups include, for example, a cyclohexyl group. The aryl groups include, for example, a phenyl group or a naphthyl group. The heterocyclic groups include, for example, a pyridyl group. The alkyl groups, cycloalkyl groups, aryl groups and heterocyclic groups include those having each a substituent. There ia no special limitation to the substituents which may include those exemplified as the substituents to the foregoing $R_5$. However, an organic groups having each a dissociative hydrogen atom such as a phenolic hydrogen atom having a pKa value of not more than 9.5 are not suitable for the substituents to $R_8$.

In the foregoing Formula Y-V, P represents a coupling group having a carbonyl or sulfonyl unit. They also include, desirably, a group represented by the following group Y-VI and, preferably, the coupling groups represented by the following group 6) to 9).

Group Y-VI

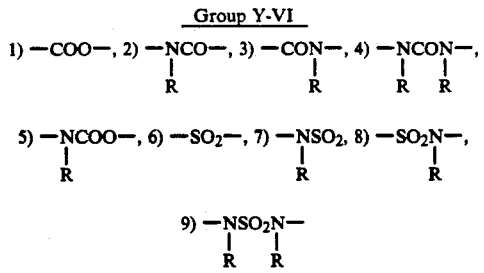

wherein R and R′ represent each a hydrogen atom, an alkyl group, an aryl group or a heterocyclic group.

The groups represented by R and R′ include, for example, the groups exemplified in the case of the foregoing $R_5$ and these groups also include those having substituents such as those exemplified as the substituents to the foregoing $R_5$. R and R′ preferable for the invention include each a hydrogen atom.

In the invention the yellow couplers represented by the foregoing Formula Y-I may be used in an amount within the range of $1\times10^{-3}$ to 1 mol and, preferably, $1\times10^{-2}$ to $8\times10^{-1}$ mols per mol of a silver halide used.

Now, the typical examples of the yellow couplers represented by the foregoing Formula Y-I will be given below.

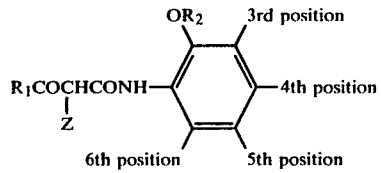
| No. | $R_1$ | $R_2$ | Z | 3rd position | 4th position | 5th position | 6th position |
|---|---|---|---|---|---|---|---|
| Y-1 | $(t)C_4H_9$— | —$CH_3$ | 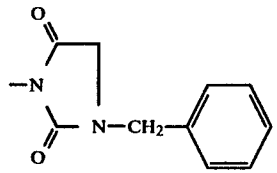 | —H | —H | 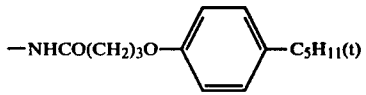 | —H |
| Y-2 | $(t)C_4H_9$— | —$CH_3$ | 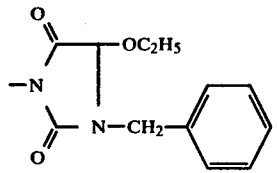 | —H | —H | 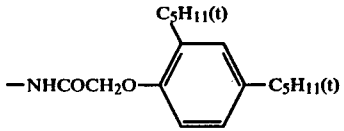 | —H |
| Y-3 | $(t)C_4H_9$— | —$CH_3$ | 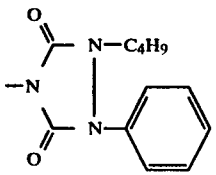 | —H | —H | 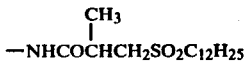 | —H |
| Y-4 | $(t)C_4H_9$— | —$CH_3$ | 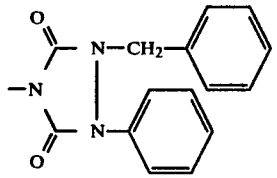 | —H | —H | 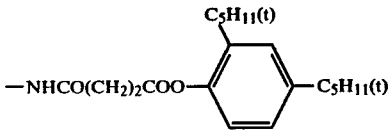 | —H |

-continued
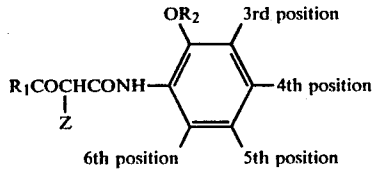
| No. | $R_1$ | $R_2$ | Z | 3rd position | 4th position | 5th position | 6th position |
|---|---|---|---|---|---|---|---|
| Y-5 | (t)$C_4H_9$— | —$CH_3$ | 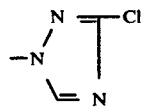 | —H | —H | 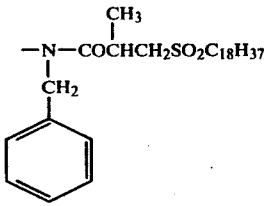 | —H |
| Y-6 | (t)$C_4H_9$— | —$CH_3$ | 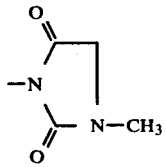 | —H | —H | —NHCO$CH_2SO_2C_{12}H_{25}$ (CH3 branch) | —H |
| Y-7 | (t)$C_4H_9$— | —$CH_3$ | 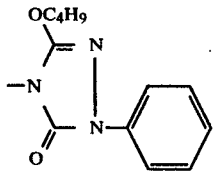 | —H | —H | —NHCO$(CH_2)_2$CONH$C_{12}H_{25}$ ($C_2H_5$ branch) | —H |
| Y-8 | (t)$C_4H_9$— | —$C_3H_7$(iso) | 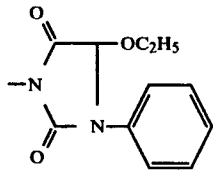 | —H | —H | 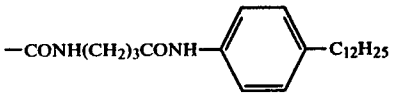 | —H |

-continued
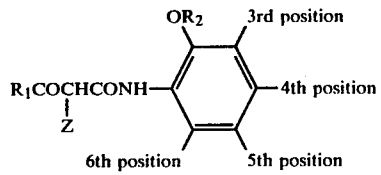
| No. | $R_1$ | $R_2$ | Z | 3rd position | 4th position | 5th position | 6th position |
|---|---|---|---|---|---|---|---|
| Y-9 | (t)$C_4H_9$— | —$CH_3$ | 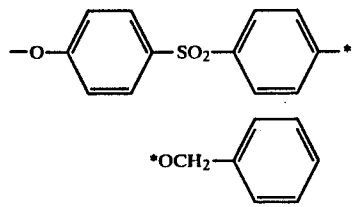 | —H | —H | 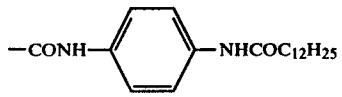 | —H |
| Y-10 | (t)$C_4H_9$— | —$C_{12}H_{25}$ | 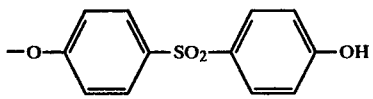 | —H | —H | —CONH—CH($CH_3$)—$CH_2SO_2C_2H_5$ | —H |
| Y-11 | (t)$C_4H_9$— | —$C_{18}H_{37}$ | 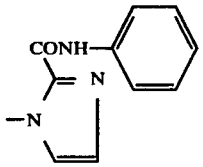 | —H | —H | —NHCO—C($CH_3$)$_2$—$CH_2SO_2C_4H_9$ | —H |
| Y-12 | (t)$C_4H_9$— | —$CH_3$ | 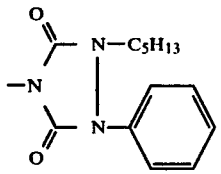 | —H | —H | 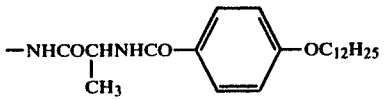 | —H |

-continued
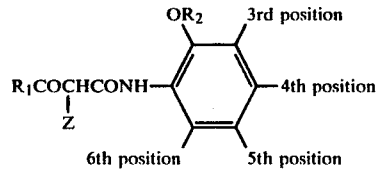
| No. | $R_1$ | $R_2$ | Z | 3rd position | 4th position | 5th position | 6th position |
|---|---|---|---|---|---|---|---|
| Y-13 | (t)$C_4H_9$— | —$C_4H_9$ | 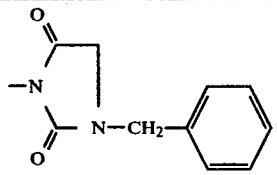 | —H | —H | 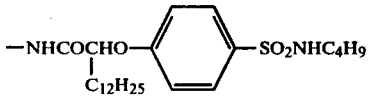 | —H |
| Y-14 | (t)$C_4H_9$— | —$CH_3$ | 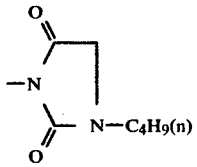 | —H | —H | —NHCOCH($CH_3$)$CH_2SO_2C_{12}H_{25}$ | —H |
| Y-15 | (t)$C_4H_9$— | —$CH_3$ | 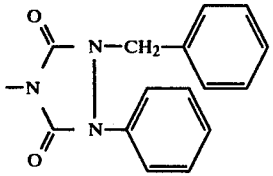 | —H | —H | —$CONH(CH_2)_2NHSO_2C_{12}H_{25}$ | —H |
| Y-16 | (t)$C_4H_9$— | —$CH_3$ | 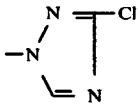 | —H | —H | —CONH($CH_3$)$CH_2SO_2CH_2$($C_8H_{13}$)$CHC_8H_{17}$ | —H |
| Y-17 | (t)$C_4H_9$— | —$CH_3$ | 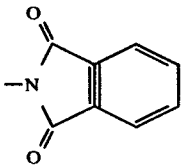 | —H | —H | 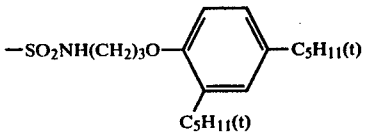 | —H |

-continued
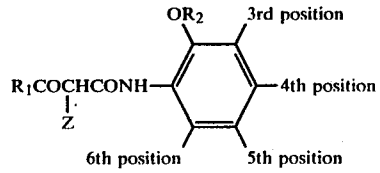
| No. | $R_1$ | $R_2$ | Z | 3rd position | 4th position | 5th position | 6th position |
|---|---|---|---|---|---|---|---|
| Y-18 | $(t)C_4H_9$— | —$CH_3$ | 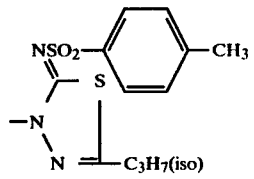 | —H | —H | 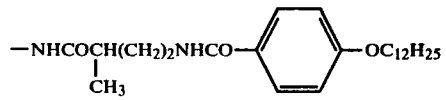 | —H |
| Y-19 | 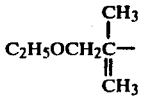 | —$CH_3$ | 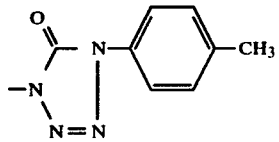 | —H | —H | —$NHCO(CH_2)_{10}COOC_2H_5$ | —H |
| Y-20 | $(t)C_4H_9$— | —$CH_3$ | 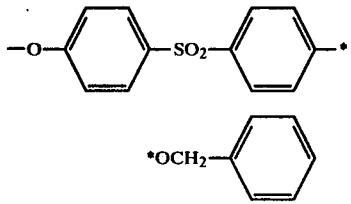 | —H | —H | 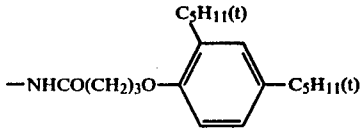 | —H |
| Y-21 | $(t)C_4H_9$— | —$CH_3$ | 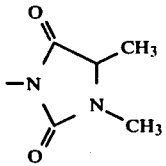 | —H | —H | —$NHCOCHCH_2SO_2C_{12}H_{25}$ (CH3) | —H |

-continued
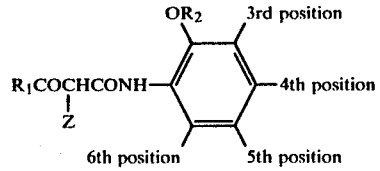
| No. | $R_1$ | $R_2$ | Z | 3rd position | 4th position | 5th position | 6th position |
|---|---|---|---|---|---|---|---|
| Y-22 | $(t)C_4H_9-$ | $-CH_3$ | 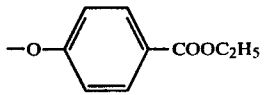 | —H | —H | 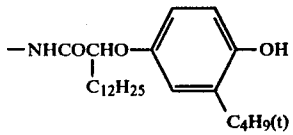 | —H |
| Y-23 | $(t)C_4H_9-$ | $-C_{12}H_{25}$ | 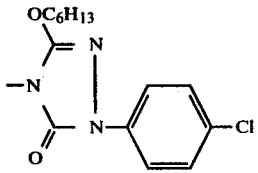 | —H | —H | $-NHCO(CH_2)_2SO_2NHCH_2CHC_4H_9$ ($C_2H_5$) | —H |
| Y-24 | $(t)C_4H_9-$ | $-C_2H_5$ | 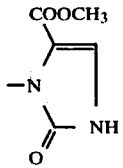 | —H | —H | 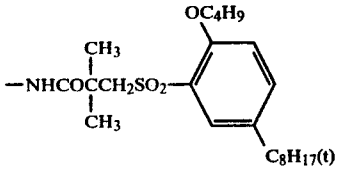 | H |
| Y-25 | 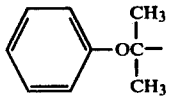 | $-C_4H_9$ | 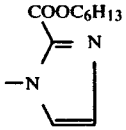 | —H | —H | $-NHSO_2C_{16}H_{33}$ | —H |

The cyan dye forming couplers preferably applicable include, for example, naphthol type couplers and phenol type couplers.

The magenta dye image forming couplers preferably applicable include, for example, 5-pyrazolone type couplers, pyrazolotriazole type couplers, pyrazolobenzimidazole type couplers, indazolone type couplers and cyanoacetyl type couplers.

The compounds such as the dye forming couplers applicable to the light sensitive materials of the invention can usually be added into a subject hydrophilic colloidal layer in the manner that the compounds are dissolved in a high boiling organic solvent having a boiling point of not lower than 150° C. or a water-insoluble polymers and, if required, by making combination use of low boiling and/or water-soluble organic solvents and then by emulsifying/dispersing them in a hydrophilic binder such as an aqueous gelatin solution by making use of a surfactant. It is also allowed to add the step for removing the low boiling organic solvent therefrom after or at the same time when the dispersion is made.

The high boiling organic solvents include, desirably, the compounds each having a dielectric constant of not higher than 6.5, such as an ester, e.g., a phthalate and a phosphate each having a dielectric constant of not higher than 6.5, an organic acid amide, a ketone and a hydrocarbon compound.

Among them, the more desirable include a high boiling organic solvent having a dielectric constant within the range of 1.9 to 6.5 and a vapor pressure of not higher than 0.9 at 100° C. Among these solvents, the more desirable ones include a phthalate or a phosphate and the most desirable one include a dialkyl phthalate having an alkyl group having not less than 9 carbon atoms. Further, the high boiling organic solvents may be a mixture of two or more kinds thereof. The above-mentioned dielectric constants are each those determined at 30° C.

The above-mentioned high boiling organic solvents are generally used in a proportion within the range of 0 to 400% by weight and, preferably, 10 to 100% by weight to a coupler used.

The light sensitive materials of the invention can be, for example, a negative or positive film of a color negative, a color paper and so forth. Among them, the effects of the invention can advantageously be displayed when making use of a color print paper for direct appreciation.

The light sensitive materials of the invention including the above-mentioned color print paper may be used for monocolor or multicolor photography.

As for the binders applicable to the silver halide photographic light sensitive materials of the invention, gelatin may preferably be used.

Gelatin commonly applicable to the photographic industry include, for example, an alkali-treated gelatin which is treated, in the course of preparing it from collagen, with lime or the like and an acid-treated gelatin which is treated, in the above-mentioned course, with hydrochloric acid. They are usually made of cattle bone, cattle hide, pig hide or the like as the raw material thereof.

The details of the preparing processes and characteristics of the above-mentioned gelatin may be referred to, for example, Arthur Veis, 'The Macromolecular Chemistry of Gelatin', Academic Press, pp.187–217, (1964); T. H. James, 'The Theory of the Photographic Process', 4th Ed., 1977, Macmillan, p.55; 'A Handbook of Scientific Photography', Vol.1, Maruzen Book Store, pp.72–75; and 'The Fundamentals of Photographic Engineering—Silver Salt Photographic Edition', Corona Co., pp.119–124.

The gelatin applicable to the light sensitive materials of the invention may be a lime-treated gelatin or an acid-treated gelatin. They may be prepared of any one of cattle bone, cattle hide and pig hide as the raw materials thereof and, among these gelatin, the lime-treated gelatin prepared of cattle bone as the raw material thereof are preferred.

In the light sensitive materials of the invention, the photographic emulsion layers and other hydrophilic colloidal layers thereof can be hardened by cross-linking the molecules of a binder or a protective colloid and then by making either independent or combination use of hardeners capable of increasing a layer hardness.

The hardener is desirably added in such an amount as is capable of hardening a light sensitive material to the extent that no hardener is needed to be added into any processing solutions. It is, however, allowed to add them into the processing solutions.

In the light sensitive materials of the invention, a UV absorbent may also be contained in the hydrophilic colloidal layers thereof such as a protective layer and an interlayer, for the purposes of preventing the light sensitive materials from any fog produced by an electric discharge from the frictionally charged light sensitive materials and from a deterioration caused by the UV rays of an image.

The light sensitive materials of the invention can be provided thereon with an auxiliary layer such as a filter layer, an antihalation layer and/or an anti-irradiation layer. In these layers and/or emulsion layers, it is also allowed to contain other dyes than the dyes of the invention, which flowed from a color light sensitive material or is bleached in the course of developing a light sensitive material.

In the light sensitive materials of the invention, a matting agent can be added into the silver halide emulsion layers and/or the other hydrophilic colloidal layers thereof, for the purposes of reducing the gloss, enhancing the retouchability and preventing the stickiness each of the light sensitive material.

A lubricant can be added to the light sensitive materials of the invention, for the purpose of reducing a sliding friction.

An antistatic agent can be added to the light sensitive materials of the invention, for the purpose of preventing an electrostaticity. The antistatic agent may sometimes be added to an antistatic layer provided onto the side of a support on which no emulsion is coated or otherwise it may also be added to an emulsion layer and/or other protective layers than the emulsion layer provided onto the side of the support on which the emulsion layer is coated.

In the light sensitive materials of the invention, a variety of surfactants may be added to the photographic emulsion layers and/or the hydrophilic colloidal layers thereof, for the purposes of improving the coatability, antistaticity, slidability, emulsification-dispersibility, adhesion-preventability and photographic characteristics such as a development acceleration, layer-hardening and sensitization, of the light sensitive materials.

In the light-sensitive material of the invention, an silver halide emulsion layer is coated, directly or through a subbing layer, on the support of the invention. The surface of the support is treated with corona discharge, UV irradiation, or flame, according to necessity before coating of the emulsion layer. The subbing layer is comprised of one or more layer for improving the adhesive property of a support surface, an antistaticity, a dimensional stability, a friction resistance, a hardness, an antihalation property, a frictional property and/or other properties.

In coating the silver halide emulsions, a thickeners may be used for improving the coatability of the light sensitive materials. As for the methods of coating the light sensitive materials, it is particularly advantageous to use an extrusion coating method and a curtain coating method in which two or more kinds of layers can be coated at the same time.

In the processing of the light sensitive materials of the invention, the color developing agents applicable to color developers include, for example, those having been widely known and used in various color photographic processes.

The above-mentioned developing agents include, for example, those of the aminophenol type and p-phenylenediamine type. These compounds are generally used in the form of, for example, a hydrochloride or a sulfate, because these forms are more stable than in the free state. Further, these compounds are generally used in a concentration within the range of, desirably, 0.1 to 30 g per liter of a color developer used and, preferably, about 1 g to about 15 g per liter of the color developer used.

The aminophenol type developing agents include, for example, o-aminophenol, p-aminophenol, 5-amino-2-oxytoluene, 2-amino-3-oxytoluene and 2-oxy-3-amino-1,4-dimethyl-benzene.

The particularly preferable primary aromatic amine type color developing agents include, for example, an N,N-dialkyl-p-phenylenediamine type compound whose alkyl and phenyl groups may be substituted with any desired substituents. The particularly useful compounds among them include, for example, an N,N-diethyl-p-phenylenediamine hydrochloride, an N-methyl-p-phenylenediamine hydrochloride, an N,N-dimethyl-p-phenylenediamine hydrochloride, a 2-amino-5-(N-ethyl-N-dodecylamino)-toluene, an N-ethyl-N-$\beta$-methanesulfonamidoethyl-3-methyl-4-aminoaniline sulfate, an N-ethyl-N-$\beta$-hydroxyethylaminoaniline, a 4-amino-3-methyl-N,N-diethylaniline and a 4-amino-N-(2-methoxyethyl)-N-ethyl-3-methylaniline-p-toluene sulfonate.

The color developers applicable to process the light sensitive materials of the invention can be added by the compounds well-known as the components of developers, besides the above-mentioned primary aromatic amine type developing agents. It is also allowed to add any desired compounds including, for example, an alkali such as sodium hydroxide, sodium carbonate and potassium carbonate, an alkali-metal sulfite, an alkali-metal bisulfite, an alkali-metal thiocyanate, an alkali-metal halide, benzyl alcohol, a water softener and a thickener.

The pH values of the above-mentioned color developers are usually not lower than 7 and, most usually, within the range of about 10 to 13.

The color developing temperature is usually not lower than 15° C. and, generally, within the range of 20° C. to 50° C. For carrying out a rapid development, it is preferable to carry out the development at a temperature of not lower than 30° C. The developing time is generally within the range of, desirably, 20 seconds to 60 seconds and, preferably, 30 seconds to 50 seconds.

The light sensitive materials of the invention may contain a color developing agent as it is or as the precursor thereof in the hydrophiic colloidal layers thereof, and the light sensitive materials can then be processes in an alkaline activation bath. The color developing agent precursors are the compounds each capable of producing a color developing agent under alkaline conditions. These precursors include, for example, a Schiff base type precursor with an aromatic aldehyde derivative, a polyvalent metal-ion complex precursor, a phthalimide derivative precursor, a phosphoramide derivative precursor, a sugar-amine reaction product precursor and a urethane type precursor. These aromatic primary amine color developing agent precursors are detailed in, for example, U.S. Pat. Nos. 3,342,599, 2,507,114, 2,695,234 and 3,719,492; British Patent No. 803,783; JP OPI Publication Nos. 53-185628(1978) and 54-79035(1979); and Research Disclosure Nos. 15159, 12146 and 13924.

The aromatic primary amine color developing agents or the precursors thereof are so required as to be added such an amount as is enough to develop a satisfactory color when carrying out an activation treatment. The amounts of them to be added are considerably varied depending on the kinds of the subject light sensitive materials. However, they are usually used in an amount within the range of 1 mol to 5 mols and, preferably, 0.5 mols to 3 mols per mol of a silver halide used. The aromatic primary amine color developing agents or the precursors thereof may be used independently or in combination.

They can be incorporated in a light sensitive material by dissolving them in a suitable solvent such as water, methanol, ethanol and acetone. They can also be added by incorporating them in the form of an dispersion thereof prepared by making use of a high boiling organic solvent such as dibutyl phthalate, dioctyl phthalate and tricresyl phosphate. They can further be added by impregnating them in a latex polymer such as those described in Research Disclosure No. 14850.

After the light sensitive materials of the invention are color-developed, they are treated in a bleaching treatment and a fixing treatment. The bleaching and fixing treatments are allowed to carry out at the same time.

The bleaching agents include a variety of compounds. Among them, a polyvalent metal compounds such as iron (III), cobalt (III) and cobalt (II) can be suitably used for. In particular, the complex salts of these polyvalent metal cations and an organic acid can be used independently or in suitable combination and they include, for example; complex salts with aminopolycarboxylic acids such as ethylenediaminetetraacetic acid, nitrilotriacetic acid and N-hydroxyethyl ethylenediaminediacetic acid, malonic acid, tartaric acid, malic acid, diglycolic acid and dithioglycolic acid; and ferricyanate and dichromate of the metal. They may be used independently or in suitable combination.

The fixers applicable thereto include, for example, a soluble complexer capable of making silver halide soluble in the form of a complex salt. The soluble complexers include, for example, sodium thiosulfate, ammonium thiosulfate, potassium thiocyanate, thiourea and thioether.

After completing a fixing treatment, a washing treatment is usually carried out. A stabilizing treatment may be carried out in place of the washing treatment, or both of the treatments may also be carried out together at the same time. The stabilizers applicable to the stabilizing treatment are allowed to contain a pH controller, a chelating agent and/or an antimold.

The detailed requirements thereof can be referred to JP OPI Publication No. 58-134636(1983).

EXAMPLES

Preparation of Blue Sensitive Silver Halide Emulsion

The following Solution A and Solution B were each added at the same time into 1000 ml of an aqueous 2% gelatin solution being kept at 40° C. with controlling the pAg and pH to be 6.5 and 3.0, respectively, by taking 30 minutes. Further, Solution C and Solution D were each added at the same time with controlling the pAg and pH to be 7.3 and 5.5, respectively, by taking 180 minutes. At this time, the pAg thereof was controlled in the method described in JP OPI Publication No. 59-45437(1984) and the pH thereof was controlled with an aqueous sulfuric acid or sodium hydroxide solution.

| | |
|---|---|
| (Solution A) | |
| Sodium chloride | 3.42% |
| Potassium bromide | 0.03% |
| Add water to make | 200 ml |
| (Solution B) | |
| Silver nitrate | 10 g |
| Add water to make | 200 ml |
| (Solution C) | |
| Sodium chloride | 102.7% |
| Potassium bromide | 1.0 g |
| $K_2IrCl_2$ | 0.01 mg |
| Add water to make | 600 ml |
| (Solution D) | |
| Silver nitrate | 300 g |
| Add water to make | 600 ml |

After completing the addition, a desalting treatment was carried out with an aqueous solution of 5% Demol N (manufactured by Kao-Atlas Corp.) and an aqueous solution of 20% magnesium sulfate and the desalted emulsion was mixed with an aqueous gelatin solution, so that a monodisperse type cubic emulsion EMP-1 having an average grain size of 0.85 μm, a variation coefficient of grain size ($\sigma/\bar{r}$) of 0.07 and a silver chloride content of 99.5 mol % could be prepared, wherein o is a standard deviation of the size and $\bar{r}$ is an average size of grains of the emulsion.

The resulting emulsion EMP-1 was chemically sensitized with the following compounds at 50° for 90 minutes, so that a blue sensitive silver halide emulsion Em B-1 could be prepared.

| | |
|---|---|
| Sodium thiosulfate | 0.8 mg/mol of AgX |
| Stabilizer, STAB-1 | $6 \times 10^{-4}$ mols/mol of AgX |
| Sensitizing dye, BS-1 | $4 \times 10^{-4}$ mols/mol of AgX |
| Sensitizing dye, BS-2 | $1 \times 10^{-4}$ mols/mol of AgX |

A monodisperse type cubic emulsion EMP-2 having an average grain size of 0.77 μm, a variation coefficient of grain size of 0.10 and a silver chloride content of 99.5 mol % was prepared in the same manner as in EMP-1, except that the time for adding each of Solution A and Solution B were changed. The resulting EMP-2 was chemically ripened in the same manner as in Em-B-1, so that a blue sensitive silver halide emulsion Em-B-2 could be prepared. The difference between the sensitive speed of Em-B-2 and that of Em-B-1 were 0.3 logE.

Sensitizing dyes BS-1 and BS-2 were each loaded with EMP-1 and were then chemically ripened, so that Em-B-3 could be prepared. The difference between the sensitive speed of the resulting Em-B-3 and that of Em-B-1 were 0.15 logE.

Comparative emulsion A having an average grain size of 0.75 μm, a variation coefficient of 0.09 and a silver chloride content of 60 mol % was prepared in the same manner as in EMP-1, except that the halogen composition of Solution C was changed, and the resulting comparative emulsion was then chemically ripened.

Preparation of Green Sensitive Silver Halide Emulsion

A monodisperse type cubic emulsion EMP-3 having an average grain size of 0.45 μm, a variation coefficient of 0.08 and a silver chloride content of 99.5 mol % and EMP-4 having an average grain size of 0.40 μm were each prepared in the same manner as in EMP-1, except that the time for adding the foregoing Solution A and Solution B and the time for adding the foregoing Solution C and Solution D were each changed, respectively. The resulting EMP-3 and EMP-4 were each chemically ripened with the following compounds at 55° C. for 120 minutes, so that green sensitive silver halide emulsions Em-G-1 and Em-G-2 could be prepared, respectively. The resulting sensitive speed difference between Em-G-1 and Em-G-2 was 0.4 logE.

| | |
|---|---|
| Sodium thiosulfate | 1.5 mg/mol of AgX |
| Chloroauric acid | 1.0 mg/mol of AgX |
| Stabilizer, STAB-1 | $6 \times 10^{-4}$ mols/mol of AgX |
| Sensitizing dye, BS-1 | $4 \times 10^{-4}$ mols/mol of AgX |

Preparation of Red Sensitive Silver Halide Emulsion

A monodisperse type cubic emulsion EMP-5 having an average grain size of 0.55 μm, a variation coefficient of 0.08 and a silver chloride content of 99.5 mol % and EMP-6 having an average grain size of 0.5 μm were each prepared in the same manner as in EMP-1, except that the time for adding the foregoing Solution A and Solution B and the time for adding the foregoing Solution C and Solution D were each changed, respectively. The resulting EMP-5 and EMP-6 were each chemically ripened with the following compounds at 55° C. for 120 minutes, so that red sensitive silver halide emulsions Em-R-1 and Em-R-2 could be prepared, respectively. The resulting sensitive speed difference between Em-R-1 and Em-R-2 was 0.4 logE.

| | |
|---|---|
| Sodium thiosulfate | 1.5 mg/mol of AgX |
| Chloroauric acid | 1.0 mg/mol of AgX |
| Stabilizer, STAB-1 | $6 \times 10^{-4}$ mols/mol of AgX |
| Sensitizing dye, RS-1 | $4 \times 10^{-4}$ mols/mol of AgX |

-continued

BS-1

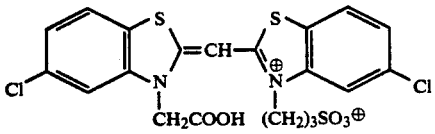

BS-2

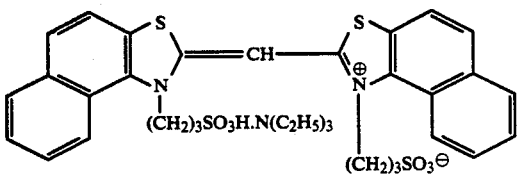

GS-1

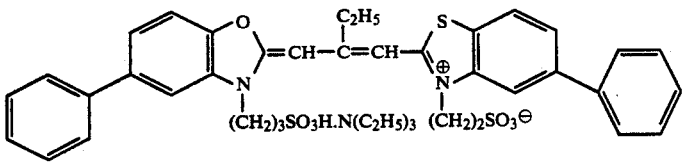

RS-1

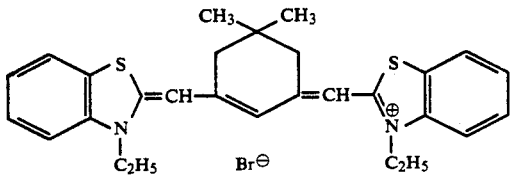

STAB-1

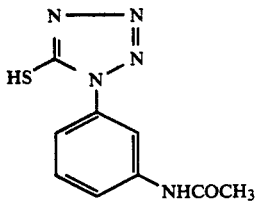

Preparation of Support

Both of the pulp of needle-leaved tree (NBSP) and those of broad-leaved tree (LBKP) were each smashed to pieces by a refiner until showing the Canadian standard freeness of 250 ml and 280 ml, respectively, and they were compounded in a proportion of 30% by weight for the former to 70% by weight for the latter. The resulting compounded pulp was made to be a paper in an inlet at a flow rate of 0.15 m/sec. The resulting paper was passed through a wet-press three times at a linear pressure of 20 kg/cm and was then treated with a bulk density press in the conditions of 35% of the moisture content of a wet paper sheet and a linear pressure of 40 kg/cm.

Next, the resulting paper was further dried by a dryer and was then machine-calendered at a linear pressure of 50 kg/cm, so that a base paper having a weight of 170 g/m$^2$ could be obtained. After the resulting raw paper was corona-discharged, a low concentrated polyethylene was extrusion-coated on the back side of the base paper and a low concentrated polyethylene containing 14% by weight of anatase type titanium oxide was coated on the front side thereof, on which an emulsion layer to be coated, so that the coated paper could have a thickness of 25 μm at a resin temperature of 330° C. Thereby, support D for photographic print paper use could be prepared. In the same manner as above, supports A and B were also obtained; provided, in A and B, the proportion by weight of the needle-leaved pulp to that of the broad-leaved pulp and the di-dimensional arithmetical mean deviation of the profile of the surface (SRa) were changed. Besides the above, support C was also prepared in the same manner as in B, except that the amount of $TiO_2$ was changed.

In the above-mentioned coating process, the linear pressure was set to be 25 kg/cm between the cooling-rolls and the pressure-rolls.

The di-dimensional arithmatic mean deviation of the profile of the surface (SRa) of each resulting support was measured through a stylus-tracing type surface roughness analyzer Model SE-30H manufactured by Kosaka Laboratories, Inc., and the results thereof were calculated in accordance with Formula [I].

In the same manner, base paper A through D each for photographic print paper use were so prepared as to have the di-dimensional arithmetical mean deviation of the profile of the surface (SRa) and the titanium oxide content of the polyethylene layers thereof such as those shown in Table-1.

TABLE 1

| Base paper No. | $TiO_2$ content of polyethylene layer | SRa (μm) |
|---|---|---|
| A | 8 | 0.16 |
| B | 8 | 0.13 |
| C | 14 | 0.16 |
| D | 14 | 0.13 |

On the resulting support A through D, the layers having the following composition were coated, so that the multilayered silver halide color photographic light sensitive materials were prepared, respectively.

Coating Solution for Layer 1

Ethyl acetate of 60 ml was so added as to be dissolved in 26.7 g Of foregoing yellow coupler (Y-6), 10.0 g of dye color image stabilizer (ST-1), 6.67 g of dye color image stabilizer (ST-2), 0.67 g of additive (HQ-1) and 6.67 g of high boiling organic solvent (DNP). The resulting solution was so dispersed in 220 ml of an aqueous gelatin solution containing 7 ml of a 20% surfactant (SU-1) by making use of a supersonic homogenizer, so that a yellow coupler dispersion could be prepared. The resulting dispersion was mixed with a blue sensitive silver halide emulsion containing 10 g of silver prepared in the following conditions shown in as follows, so that the coating solution for layer 1 could be prepared.

The coating solutions each for layers 2 through 7 could be prepared in the same manner as in the coating solution for layer 1.

As for the hardeners, H-1 were each added to layers 2 and 4, and H-2 was added to layer 7. As for the coating aids, surfactants SU-2 and SU 3 were so added as to control the surface tension.

Samples 1 to 17 were prepared, in which the supports, compositions of the emulsions and yellow couplers were changed as given in Table 2.

| Layer | Composition | Amount added ($g/m^2$) |
|---|---|---|
| Layer 7 (Protective layer) | Gelatin | 1.00 |
| | Antistaining agent, HQ-2 | 0.002 |
| | Antistaining agent, HQ-3 | 0.002 |
| | Antistaining agent, HQ-4 | 0.004 |
| | Antistaining agent, HQ-5 | 0.02 |
| | DIDP | 0.005 |
| | Compound, F-1 | 0.002 |
| Layer 6 (UV absorbing layer) | Gelatin | 0.40 |
| | UV absorbent, UV-1 | 0.10 |
| | UV absorbent, UV-2 | 0.04 |
| | UV absorbent, UV-3 | 0.16 |
| | Antistaining agent, HQ-5 | 0.04 |
| | DNP | 0.20 |
| | PVP | 0.03 |
| | Anti-irradiation dye, AI-2 | 0.02 |
| | Anti-irradiation dye, AI-4 | 0.01 |
| Layer 5 (Red-sensitive layer) | Gelatin | 1.30 |
| | Red-sensitive silver chlorobromide emulsion <See Table 2> | 0.21 |
| | Cyan coupler, C-1 | 0.17 |
| | Cyan coupler, C-2 | 0.25 |
| | Dye image stabilizer, ST-1 | 0.20 |
| | Antistaining agent, HQ-1 | 0.01 |
| | HBS-1 | 0.20 |
| | DOP | 0.20 |
| Layer 4 (UV absorbing layer) | Gelatin | 0.94 |
| | UV absorbent, UV-1 | 0.28 |
| | UV absorbent, UV-2 | 0.09 |
| | UV absorbent, UV-3 | 0.38 |
| | Antistaining agent, HQ-5 | 0.10 |
| | DNP | 0.40 |
| Layer 3 (Green sensitive layer) | Gelatin | 1.40 |
| | Green-sensitive silver chlorobromide emulsion <See Table 2> | 0.17 |
| | Magenta coupler, M-1 | 0.23 |
| | Dye image stabilizer, ST-3 | 0.20 |
| | Dye image stabilizer, ST-4 | 0.17 |
| | DIDP | 0.13 |
| | DBP | 0.13 |
| | Anti-irradiation dye, AI-1 | 0.01 |
| Layer 2 (Interlayer) | Gelatin | 1.20 |
| | Antistaining agent, HQ-2 | 0.03 |
| | Antistaining agent, HQ-3 | 0.03 |
| | Antistaining agent, HQ-4 | 0.05 |
| | Antistaining agent, HQ-5 | 0.23 |
| | DIDP | 0.06 |
| | Compound, F-1 | 0.002 |
| Layer 1 (Blue sensitive layer) | Gelatin | 1.20 |
| | Blue-sensitive silver chlorobromide emulsion <See Table 2> | 0.26 |
| | Yellow coupler, Y-6 | 0.80 |
| | Dye image stabilizer, ST-1 | 0.30 |
| | Dye image stabilizer, ST-2 | 0.20 |
| | Antistaining agent, HQ-1 | 0.02 |
| | Anti-irradiation dye, AI-3 | 0.01 |
| | DNP | 0.20 |
| Support | Polyethylene-laminated paper | |

In the table, the amounts of the silver halide emulsions are indicated in terms of the silver.

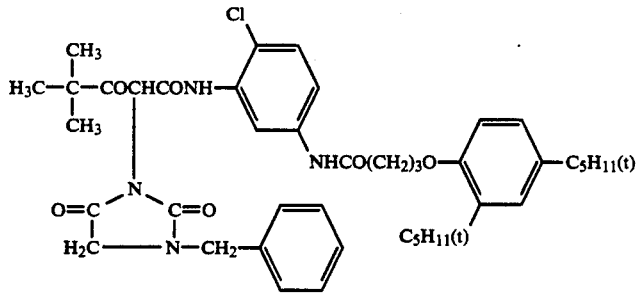

Y-S-1

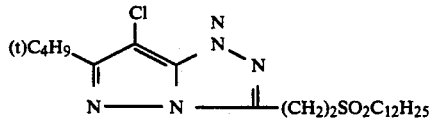

M-1

-continued
C-1
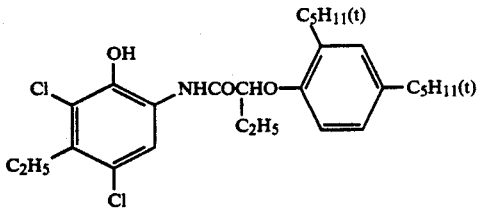
C-2
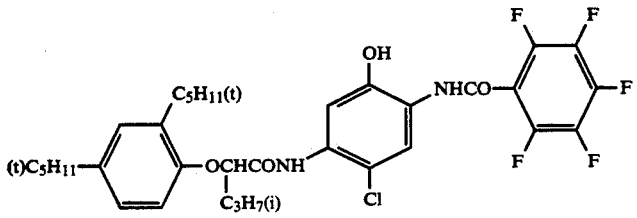
ST-1
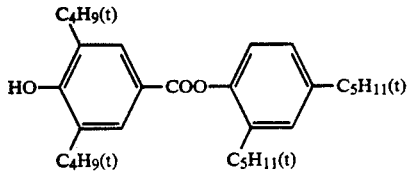
ST-2
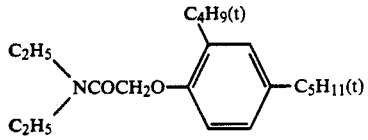
ST-3
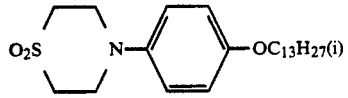
ST-4
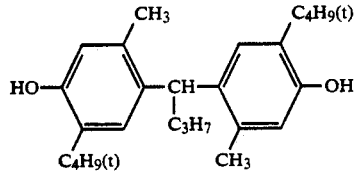
UV-1
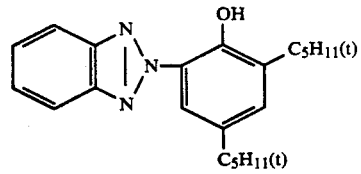
UV-2
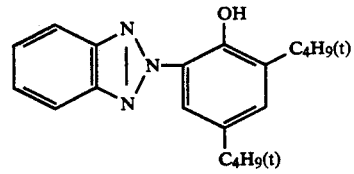
UV-3
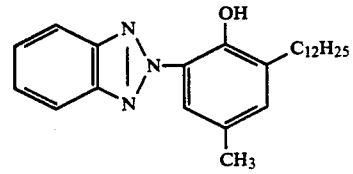
DBP: Dibutyl phthalate -continued
DOP: Dioctyl phthalate
DNP: Dinonyl phthalate
DIDP: Diisodecyl phthalate
PVP: Polyvinyl pyrrolidone
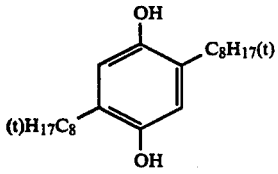
HQ-1
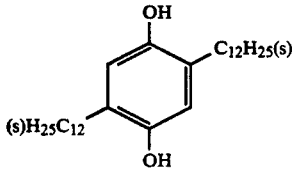
HQ-2
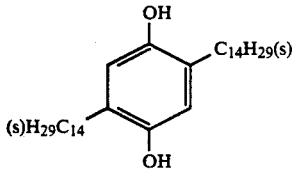
HQ-3
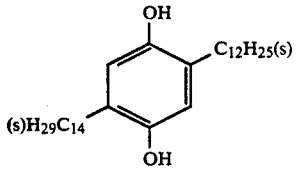
HQ-4
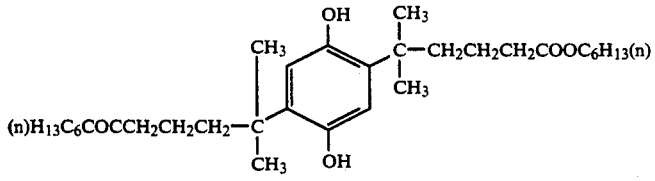
HHQ-5
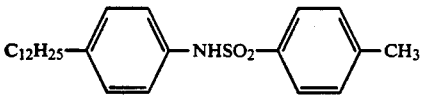
HBS-1
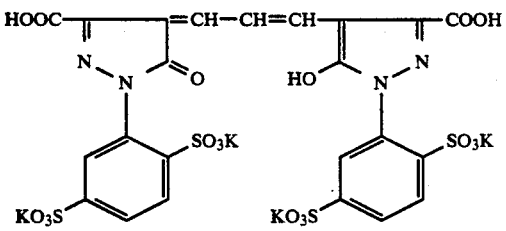
AI-1
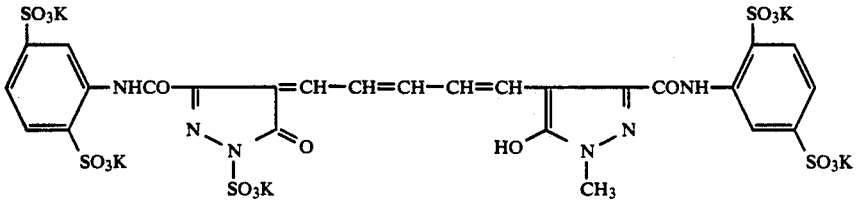
AI-2

-continued

AI-3

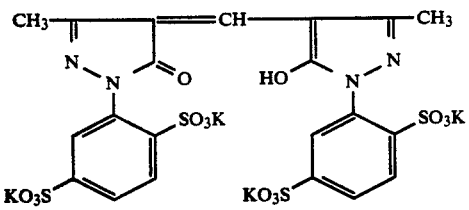

AI-4

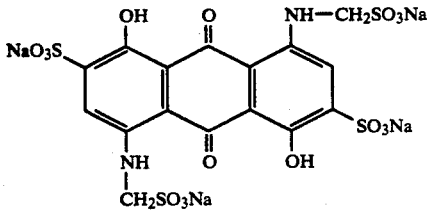

SU-1

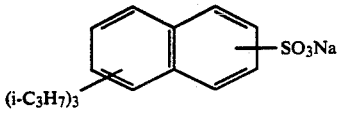

SU-2

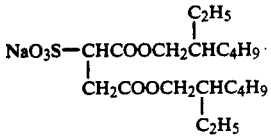

SU-3

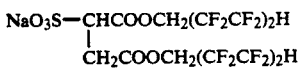

H-1

$C(CH_2SO_2CH{=}CH_2)_4$

H-2

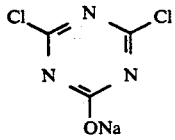

F-1

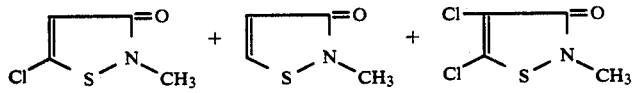

(50%) (46%) (4%)

Mol ratio

TABLE 2

| Sample No. | Base paper | Blue-sensitive layer: Emulsion | Blue-sensitive layer: Yellow Coupler | Green-sensitive layer | Red-sensitive layer |
|---|---|---|---|---|---|
| 1 | A | Comparative A | Y-6 | G-1 | R-1 |
| 2 | B | Comparative A | Y-6 | G-1 | R-1 |
| 3 | A | B-1 | Y-6 | G-1 | R-1 |
| 4 | B | B-1 | Y-6 | G-1 | R-1 |
| 5 | A | B-1 + B-2 | Y-6 | G-1 | R-1 |
| 6 | B | B-1 + B-2 | Y-6 | G-1 | R-1 |
| 7 | C | B-1 + B-2 | Y-6 | G-1 | R-1 |
| 8 | D | B-1 + B-2 | Y-6 | G-1 | R-1 |
| 9 | D | B-1 + B-2 | Y-6 | G-1 + G-2 | R-1 |
| 10 | D | B-1 + B-2 | Y-6 | G-1 + G-2 | R-1 + R-2 |
| 11 | D | B-1 + B-3 | Y-6 | G-1 + G-2 | R-1 + R-2 |
| 12 | D | B-1 + B-2 | Y-3 | G-1 + G-2 | R-1 + R-2 |
| 13 | D | B-1 + B-2 | Y-8 | G-1 + G-2 | R-1 + R-2 |
| 14 | D | B-1 + B-2 | Y-15 | G-1 + G-2 | R-1 + R-2 |

TABLE 2-continued

| Sample No. | Base paper | Blue-sensitive layer: Emulsion | Blue-sensitive layer: Yellow Coupler | Green-sensitive layer | Red-sensitive layer |
|---|---|---|---|---|---|
| 15 | D | B-1 + B-2 | Y-17 | G-1 + G-2 | R-1 + R-2 |
| 16 | D | B-1 + B-2 | Y-21 | G-1 + G-2 | R-1 + R-2 |
| 17 | D | B-1 + B-2 | YS-1 | G-1 + G-2 | R-1 + R-2 |

After the resulting samples were each ordinarily exposed to light and developed, the sensitometry of each developed samples are carried out.

The resulting sensitive speeds thereof were expressed in terms of the reciprocals of the exposure quantity necessary to obtain a reflection density of 0.8, and the samples were evaluated according to the relative values of the speeds. The gradations thereof were expressed in the terms of the gradient of the line connecting the points of the reflection densities from 0.8 to 1.8 on the characteristic curve. A higher value of the gradient corresponds to higher contrast of image which causes degradation in the reproducibility of shadow gradation in the image. The sharpnesses thereof were evaluated in terms of the values determined by the following equation in the manner that each of the samples was exposed to blue light through a resolving power test chart and the densities of each color-image were measured by a microphotometer.

Sharpness (%)

$$\frac{\text{(A maximum density − a minimum density) of 1 contact printed image of 3 lines/mm}}{\text{(A maximum density − a minimum density) of a large area}} \times 100$$

It is indicated that the larger the values obtained from the above-given equation, the more the sharpness is excellent. Table-3 shows the results of the photographic characteristics and sharpness of the blue sensitive layer.

| Processing Step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30 to 34° C. | 90 sec. |
| Drying | 60 to 80° C. | 60 sec. |
| Color developer | | |
| Pure water | | 800 ml |
| Triethanolamine | | 10 g |
| N,N,-diethylhydroxylamine | | 5 g |
| Potassium bromide | | 0.02 g |
| Potassium sulfite | | 0.3 g |
| 1-hydroxyethylidene-1,1-siphosphonate | | 1.0 g |
| Ethylenediamine tetraacetic acid | | 1.0 g |
| Disodium catechol-3,5-diphosphonate | | 1.0 g |
| N-ethyl-N-β-methanesulfonamidoethyl-3-ethyl-4-aminoaniline sulfate | | 4.5 g |
| Fluorescent whitening agent, (a 4,4'-diaminostilbene sulfonic acid derivative) | | 1.0 g |
| Potassium carbonate | | 27 g |
| Add water to make in total of | | 1 liter |
| Adjust pH to be | | pH = 10.10 |
| Bleach-fixer | | |
| Ferric ammonium ethylenediamine-tetraacetate, dihydrate | | 60 g |
| Ethylenediamine tetraacetic acid | | 3 g |
| Ammonium thiosulfate, (in an aqueous 70% solution) | | 100 ml |
| Ammonium sulfite, (in an aqueous 40% solution) | | 27.5 ml |
| Add water to make in total of | | 1 liter |
| Adjust pH with potassium carbonate or glacial acetic acid to be | | pH = 5.7 |
| Stabilizer | | |
| 5-chloro-2-methyl-4-isothiazoline-3-one | | 1.0 g |
| Ethylene glycol | | 1.0 g |
| 1-hydroxyethylidene-1,1-diphosphonic acid | | 2.0 g |
| Ethylenediamine tetraacetic acid | | 1.0 g |
| Ammonium hydroxide, (in an aqueous 20% solution) | | 3.0 g |
| Fluorescent whitening agent, (a 4,4'-diaminostilbene sulfonic acid derivative) | | 1.5 g |
| Add water to make in total of | | 1 liter |
| Adjust pH with sulfuric acid or potassium hydroxide to be | | pH = 7.0 |

TABLE 3

| Sample No. | Sensitivity | Gradation | Sharpness |
|---|---|---|---|
| 1 | 100 | 3.16 | 0.70 |
| 2 | 100 | 3.15 | 0.73 |
| 3 | 120 | 3.20 | 0.69 |

TABLE 3-continued

| Sample No. | Sensitivity | Gradation | Sharpness |
|---|---|---|---|
| 4 | 123 | 3.21 | 0.73 |
| 5 | 119 | 2.90 | 0.65 |
| 6 | 120 | 2.85 | 0.67 |
| 7 | 120 | 2.88 | 0.69 |
| 8 | 121 | 2.87 | 0.74 |
| 9 | 119 | 2.88 | 0.74 |
| 10 | 119 | 2.88 | 0.75 |
| 11 | 122 | 2.93 | 0 75 |
| 12 | 122 | 2.85 | 0.75 |
| 13 | 120 | 2.85 | 0.74 |
| 14 | 123 | 2.87 | 0.75 |
| 15 | 122 | 2.87 | 0.75 |
| 16 | 120 | 2.85 | 0.75 |
| 17 | 115 | 2.88 | 0.74 |

From the above-given Table-3, it was proved that Samples 1 and 2 were low in sensitive speeds; that Samples 3 and 4 were hard in gradation and poor in shadow expression; and that Samples 5, 6 and 7 were poor in sharpness, though they were improved on shadow expression. In contrast to the above, it was proved that Samples 8 through 17 each of the invention were improved on the sensitive speeds, shadow expression and sharpness, either.

EXAMPLE 2

After Samples 1, 9, 10 and 11 of Example 1 were each exposed to green light, the resulting color images thereof were measured in the same manner as in Example 1, and each sensitometry and sharpness thereof were evaluated. The results thereof are shown in Table-4 given below.

TABLE 4

| Sample No. | Sensitivity | Gradation | Sharpness |
|---|---|---|---|
| 1 (comparative) | 100 | 3.43 | 0.67 |
| 9 | 115 | 3.12 | 0.78 |
| 10 | 117 | 3.13 | 0.77 |
| 11 | 115 | 3.13 | 0.77 |

From the above-given Table-4, it was proved that Samples 1 (comparative) was low in sensitive speeds, hard in gradation and poor in sharpness. In contrast to the above, it was proved that Samples of the invention were excellent in sensitive speeds, shadow expression and sharpness, either.

EXAMPLE 3

Samples 1, 10 and 11 of Example 1 were each exposed to red light and the sensitometry and sharpness thereof were evaluated in the same manners as in Example 1. The results thereof are shown in Table-5 in which the same results as in Example 1 were proved.

TABLE 5

| Sample No. | Sensitivity | Gradation | Sharpness |
|---|---|---|---|
| 1 (comparative) | 100 | 3.55 | 0.62 |
| 10 | 120 | 3.20 | 0.72 |
| 11 | 122 | 3.22 | 0.73 |

What is claimed is:

1. A silver halide photographic light-sensitive material comprising a paper substrate which has polyolefin resin layers on both sides thereof, and a silver halide emulsion layer provided on one of said polyolefin layers, wherein said polyolefin layer on which said silver halide emulsion layer to be provided contains white pigment particles in an amount of not less than 13 weight percent of a polyolefin resin contained in said polyolefin layer, and the surface of said polyolefin layer on which said silver halide emulsion layer to be provided has a di-dimensional arithmetical means deviation of the profile, SRa, of not larger than 0.14 μm, said SRa is calculated by the following Equation I, and said silver halide emulsion layer comprises at least two kinds of monodispersed silver halide emulsions each having a silver chloride content of not less than 90 mole % and being different from each other in speed thereof and a yellow coupler:

$$SRa = \frac{1}{S_M} \int_0^{Lx} \int_0^{Ly} |f(x,y)| \, dxdy \qquad \text{Equation I}$$

wherein Lx is the length of measuring area of specimen in X-axis direction of 5 mm and Ly is the length of measuring area of specimen in Y-axis direction of 1 mm and SM is the measuring area of specimen of 5 $mm^2$.

2. The light-sensitive material of claim 1, wherein white pigment is contained in said polyolefin resin layer in an amount of 13 to 50% by weight of said polyolefin resin.

3. The light-sensitive material of claim 1, wherein the thickness of said polyolefin resin layer containing said white pigment is 5 to 200 μm.

4. The light-sensitive material of claim 3, wherein the thickness of said polyolefin resin layer containing said white pigment is 30 to 100 μm.

5. The light-sensitive material of claim 1, wherein said di-dimensional arithmetical mean deviation of the profile SRa is within the range of 0.05 μm to 0.14 μm.

6. The light-sensitive material of claim 1, wherein said white pigment is barium sulfate or titanium oxide.

7. The light-sensitive material of claim 6, wherein said white pigment is titanium oxide.

8. The light-sensitive material of claim 1, wherein said silver halide emulsions each comprises silver chlorobromide grains containing 95 mol % of silver chloride.

9. The light-sensitive material of claim 8, wherein said silver halide emulsions each comprises silver chlorobromide grains containing 99 mol % of silver chloride.

10. The light-sensitive material of claim 1, wherein the difference of said two kinds of silver halide emulsions in the speed is 0.05 to 0.6 in terms of logE.

11. The light-sensitive material of claim 10, wherein the difference of said two kinds of silver halide emulsions in speed is 0.1 to 0.5 in terms of logE.

12. The light-sensitive material of claim 1, wherein said silver halide emulsions each has a variation coefficient of grain size of not more than 0.22.

13. The light-sensitive material of claim 12, wherein said silver halide emulsions each has a variation coefficient of grain size of not more than 0.15.

14. The light-sensitive material of claim 1, wherein said emulsion layer contains a yellow coupler represented by Formula Y-1:

Formula Y-1

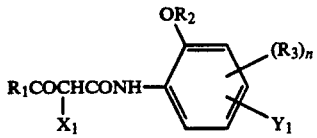

wherein $R_1$ is an alkyl group or a cycloalkyl group; $R_2$ is an alkyl group, a cycloalkyl group, an acyl group or an aryl group; $R_3$ is a substituent; n is 0 or 1; $X_1$ is a hydrogen atom or a substituent capable of splitting off upon reaction with the oxidation product of a color developing agent; and $Y_1$ is an organic group.

15. The light-sensitive material of claim 1, wherein white pigment is contained in said polyolefin resin layer in an amount of 13 to 60% by weight of said polyolefin resin; the thickness of said polyolefin resin layer contained said white pigment is 5 to 200 μm; and said white pigment is barium sulfate or titanium oxide.

16. The light-sensitive material of claim 3, wherein the thickness of said polyolefin resin layer containing said white pigment is 30 to 100 μm; and said di-dimensional arithmetical means deviation of the profile SRa is within the range of 0.05 μm to 0.14 μm.

17. The light-sensitive material of claim 14, wherein white pigment is contained in said polyolefin resin layer in an amount of 13 to 50% by weight of said polyolefin resin; the thickness of said polyolefin resin layer contained said white pigment is 5 to 200 μm; and said white pigment is barium sulfate or titanium oxide.

18. The light-sensitive material of claim 17, wherein the thickness of said polyolefin resin layer containing said white pigment is 30 to 100 μm; and said di-dimensional arithmetical means deviation of the profile SRa is within the range of 0.05 μm to 0.14 μm.

* * * * *